US006382766B1

(12) United States Patent
Park

(10) Patent No.: US 6,382,766 B1
(45) Date of Patent: May 7, 2002

(54) MAINTENANCE APPARATUS FOR INK NOZZLE OF IMAGE FORMING APPARATUS

(75) Inventor: Jin-Ho Park, Sungnam (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/553,026

(22) Filed: Apr. 20, 2000

(51) Int. Cl.[7] ..... B41J 2/165
(52) U.S. Cl. ..... 347/30
(58) Field of Search ..... 347/29, 30, 31, 347/33

(56) References Cited

U.S. PATENT DOCUMENTS

| | | | | | |
|---|---|---|---|---|---|
| 4,074,037 | A | * | 2/1978 | Nakahara et al. | 347/29 |
| 5,146,243 | A | * | 9/1992 | English et al. | 347/30 |
| 5,404,158 | A | | 4/1995 | Carlotta et al. | |
| 5,534,896 | A | * | 7/1996 | Ocborne | 347/29 |
| 5,548,310 | A | | 8/1996 | Binner et al. | |
| 5,587,729 | A | | 12/1996 | Lee et al. | |
| 5,627,574 | A | | 5/1997 | Fahy | |
| 5,714,991 | A | * | 2/1998 | Osborne et al. | 347/30 |
| 5,917,516 | A | | 6/1999 | Nguyen et al. | |

FOREIGN PATENT DOCUMENTS

| | | | |
|---|---|---|---|
| EP | 526010 | * | 3/1993 |
| EP | 604067 | * | 6/1994 |

* cited by examiner

*Primary Examiner*—John Barlow
*Assistant Examiner*—Ly T Tran
(74) *Attorney, Agent, or Firm*—Robert E. Bushnell, Esq.

(57) ABSTRACT

An improved ink jetting nozzle maintenance apparatus not only for preventing a blockage in a nozzle with a minimum number of parts for a service station device for service function for reducing ink vaporization at the nozzle during a standby mode, but also for performing an ink suctioning without causing a delay in the printing operation. In the ink jetting nozzle maintenance apparatus including a cap for preventing any blockage in an ink nozzle during the standby mode, a wiper for wiping an ink nozzle surface, a capping device and a wiping device for raising and lowering the capping cap and the wiper, and a service station device having a carriage which carries an ink cartridge for a printing operation, for driving the capping and wiping devices by the reciprocal movement of the carriage, the cap including a suction diaphragm for expanding the volume of a cap space formed during the sealing of the nozzle, the suction diaphragm is extended by the suction diaphragm lowering unit which lowers the suction diaphragm in the opposite direction from the nozzle for expanding the volume of the cap space when the capping cap seals the nozzle and additionally moves a certain distance, the cap space being subjected to a negative pressure by the extending of the suction diaphragm to permit a certain amount of ink to be sucked out of the nozzle for preventing the drying of an inlet of the nozzle, and the ink sucked out by the negative pressure into droplets to prevent the nozzle drying is wiped out by the wiper during the wiping operation for the printing operation.

20 Claims, 13 Drawing Sheets

MAINTENANCE APPARATUS FOR INK NOZZLE OF IMAGE FORMING APPARATUS

BACKGROUND OF THE INVENTION

1. Field of the Invention

The present invention relates to an image forming apparatus such as an ink jet printer for forming an image by using ink, and more particularly, to an ink jetting nozzle maintenance apparatus of an image forming apparatus capable of preventing a blockage in an ink nozzle while a service station device, which is driven by the reciprocal movement of a carriage, is in the standby mode.

2. Description of the Related Art

Generally, when an ink cartridge is in the standby mode in an image forming apparatus, a jetting nozzle is exposed to the atmosphere and ink vaporizes, producing a sludge. Accordingly, contaminants such as dust block an inlet of the nozzle approximately of 20–40 $\mu$, deteriorating the print quality during a printing operation.

Accordingly, it has been suggested that the image forming apparatus employ a structure for preventing vaporization of the ink by sealing the nozzle surface of the ink cartridge in the standby mode. Such a structure includes a structure for wiping the nozzle surface with a wiper, and a structure for suctioning the nozzle surface with a pump.

Accordingly, as shown in FIG. 1, this suggested structure requires a separate pump for sucking in the ink, and a driving source for driving the pump.

Referring to FIG. 1, the conventional image forming apparatus includes a vaporization prevention cap 3 with a pump 5 which is connected to the vaporization prevention cap 3 through a tube 4, for suctioning the nozzle surface of the ink cartridge 1 and thus for preventing inefficient ink jetting from occurring due to a blockage in the nozzle 2 by sludge and dust, and a motor 6 for serving the function of a driving source for driving the pump 5.

Accordingly, the pump 5 is driven by the driving force from the motor 6 to suck in, and to waste the ink to an ink absorbing pad or a waste ink bin 7. The conventional ink forming apparatus, however, has a disadvantage in view of an economical manner since it requires a separate driving source, complicating the structure and increasing the unit price. Further, since the ink is sucked and wasted in every printing operation, a considerable amount of ink is wasted when considering the actual ink amount used for the printing operation. As a result, a user has to go to great expense for the ink consumption.

Further, since the ink is sucked in only after the nozzle is sealed by the vaporization prevention cap 3, the printing operation time is lengthened.

Due to the above-mentioned problems, image forming apparatuses rarely employ an ink pumping structure. resulting in the problems of nozzle blockage by the sludge and dust.

In other words, even though it is recognized that there is printing deterioration by the nozzle blockage due to the sludge and dust, the disadvantages such as increased cost and operation time result in most of the ink forming apparatus manufacturers doing nothing to correct the problem. The ink forming apparatus manufactures only perform a capping operation to seal the nozzle, wiping operation to scratch the nozzle, and spitting operation for a preliminary jetting, all by a service station apparatus (or so-called 'home assembly'). The service station is driven by a carriage carrying the ink cartridge and reciprocating for the printing operation. Such a service station apparatus has already been disclosed and open to the public by the Korean Utility Model Publication No. 97-28155.

Although the above-mentioned service station apparatus has the advantage of low manufacturing cost, it has the disadvantage of nozzle blockage low printing quality, and reliability deterioration.

SUMMARY OF THE INVENTION

The present invention has been developed to overcome the above-mentioned problems and disadvantages of the prior art, and accordingly, it is an object of the present invention to provide an improved ink jetting nozzle maintenance apparatus capable of preventing nozzle blockage and performing an ink suctioning without delay.

The above object is accomplished by an image forming apparatus according to the present invention, including an ink cartridge holding ink for a printing operation, for jetting the ink toward an ink nozzle when receiving a printing command; a carriage for reciprocally moving on a paper in a horizontal direction while carrying an ink cartridge for a printing operation, the carriage for moving to a service area during the standby mode or a power-off period. A service station device driven by the reciprocal movement of the carriage a suction diaphragm formed in the cap for preventing the nozzle from drying by sucking out a certain amount of ink from the ink nozzle by using the cap; and a diaphragm lowering section driven by the reciprocal movement of the carriage for driving the service station device, for generating a pulling force for pulling the suction diaphragm to generate a negative pressure to suction the ink from the ink nozzle. The service station device having a cap for sealing the ink nozzle to prevent the drying of the ink nozzle of the ink cartridge; and a wiper for wiping the nozzle during a printing operation or during a paper feeding operation.

According to the features of the present invention, the ink droplets that are sucked out under the negative pressure remain at the ink nozzle prevent the nozzle from drying, and the ink-nozzle is wiped out by the wiper during the wiping operation for the printing operation.

Further, the cap, which includes the suction diaphragm, is formed of a rubber member having a certain elasticity for the extending of the suction diaphragm.

The diaphragm lowering section according to the present invention includes a suction rod for pulling the suction diaphragm; a rod guide connected to the suction rod for a lowering movement of the suction rod; and a cam groove formed on an inner wall of the housing for guiding upward and downward the movement of the rod guide.

It is another feature of the present invention that the cam groove is in a predetermined trajectory for a lowering operation which is to pull the suction diaphragm from the point when the cap seals the nozzle.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

Hereinafter, the ink jetting nozzle maintenance apparatus according to the preferred embodiment of the present invention will be described in greater detail with respect to the accompanying drawings.

Figure 1:
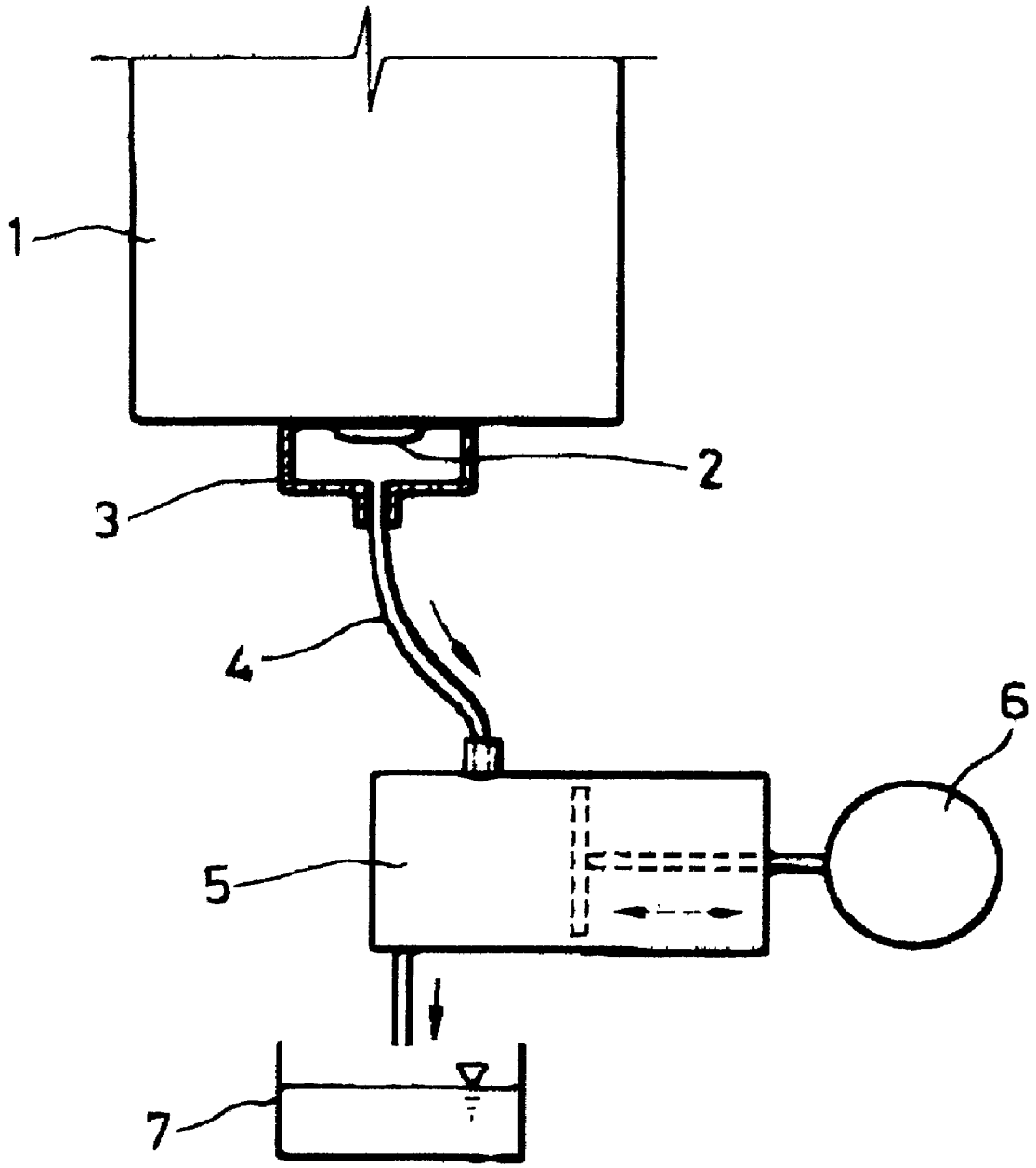
FIG. 1 is a schematic view for explaining one example of a prior art ink jetting nozzle maintenance apparatus.
Figure 2:
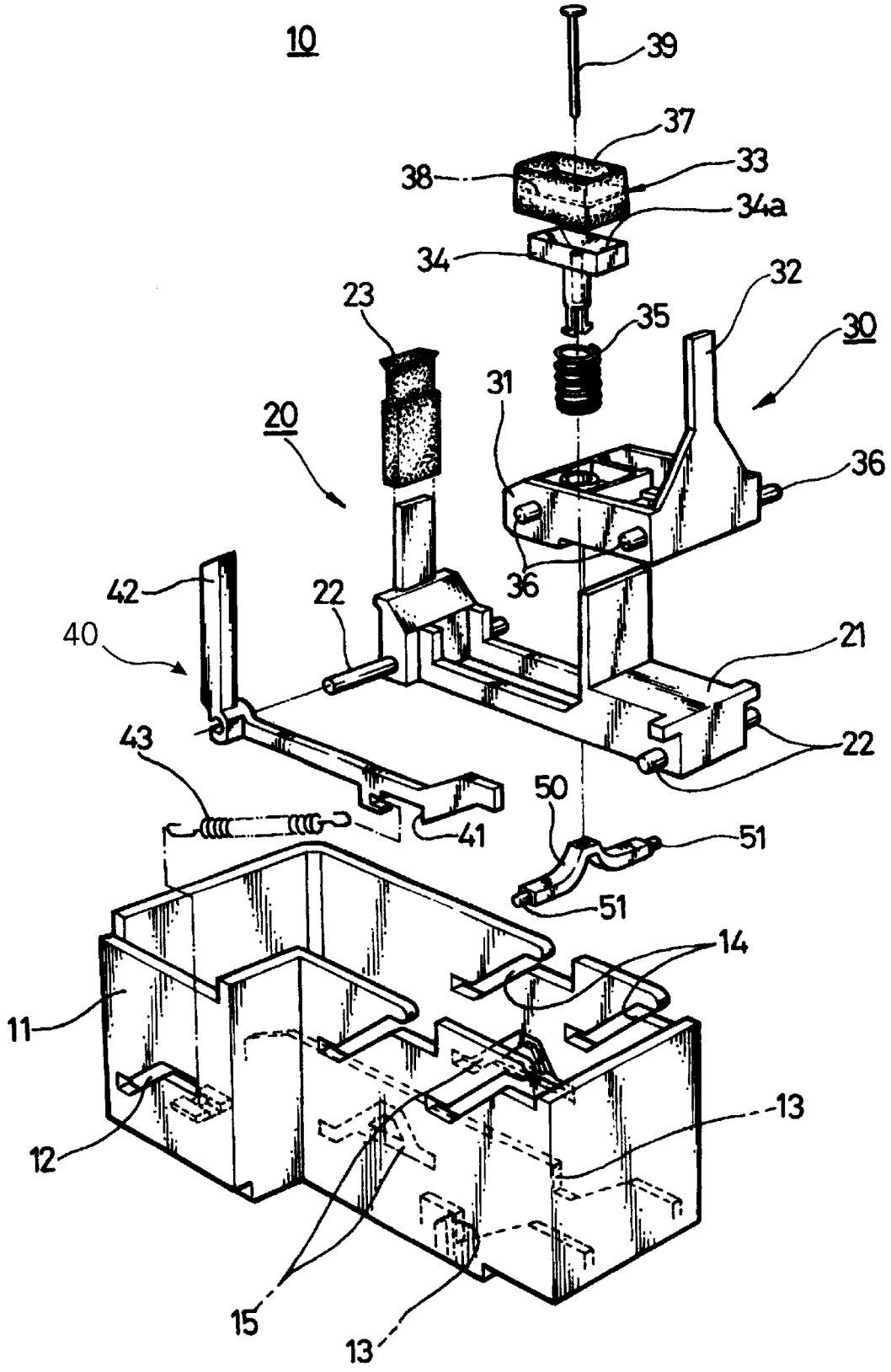
FIG. 2 is an exploded perspective view of a service station apparatus according to the present invention.

FIG. 2 is an exploded perspective view for showing a service station apparatus 10 according to the present invention, including a housing 11 mounted on a printer casing (not shown), a wiping device 20 horizontally and vertically moving within the housing 11 for wiping the nozzle 2 of the ink cartridge 1, and a capping device 30 mounted on the wiping device 20 for screening the nozzle 2 from external environment.

The wiping device 20 includes a wiper guide 21 having guiding protrusions 22 moving along guiding sections 12 formed on both sides of the housing 11, and a wiper 23 formed on one side of the wiper guide 21 and having a certain elasticity for being inclined when wiping the nozzle 2.

Further, there is a locking rod 40 pivotally disposed on the guiding protrusions 22 on one side of the wiper guide 21 for locking and unlocking the capping device 30 and the wiping device 20. Accordingly, the locking rod 40 is moved along with the wiper guide 21, and includes a locking tongue 41 locked with a locking elevation 13 formed on the housing 11, and an unlocking lever 42 for rotating the locking rod 40 to unlock the locking tongue 41 from the locking elevation 13.

The unlocking lever 42 is inclined backward by the pushing force of the carriage 8 which carries the ink cartridge 1 thereon and moves for the printing operation. The elastic member 43 connected to the locking rod 40 and the housing 11 has a certain elasticity enough to return the wiping device 20, and capping device 30 and the locking rod 40 thereof to a lower position.

The capping device 30 includes a capping guide 31 having a lever 32 for being pushed by the carriage 8 which carries the ink cartridge 1 and reciprocally moves, guiding protrusions 36 formed on the front and rear portions of both sides of the capping guide 31 being guided along the guiding sections 14 of the housing 11, a cap 33 for sealing the nozzle 2, a cap guide 34 for movably supporting the cap 33 upright on the capping guide 31, and a cap sealing elastic member 35 for pressing the cap 33 into tight contact with the nozzle 2 with a certain elasticity.

Further, an ink nozzle maintenance device is also provided. Since the cap 33 is in tight contact with the nozzle 2. the cap 33 should be made of a rubber substance which has a certain flexibility to prevent any scratch formation on the nozzle 2 when the cap 33 is pressed by the cap sealing elastic member 35 against the nozzle 2 with a certain elasticity.

According to the present invention, the cap 33 made of rubber includes a cap space 37 formed therein, and a suction diaphragm 38 made in a thin plate shape for expanding the cap space 37. The suction diaphragm 38 and the cap 33 are integrally formed with each other.

Further, a suction rod 39 is provided to pull the suction diaphragm 38, and is connected with a rod guide 50 which is passed through the cap guide 34 to give a pulling force to the suction diaphragm 38.

Figure 5:
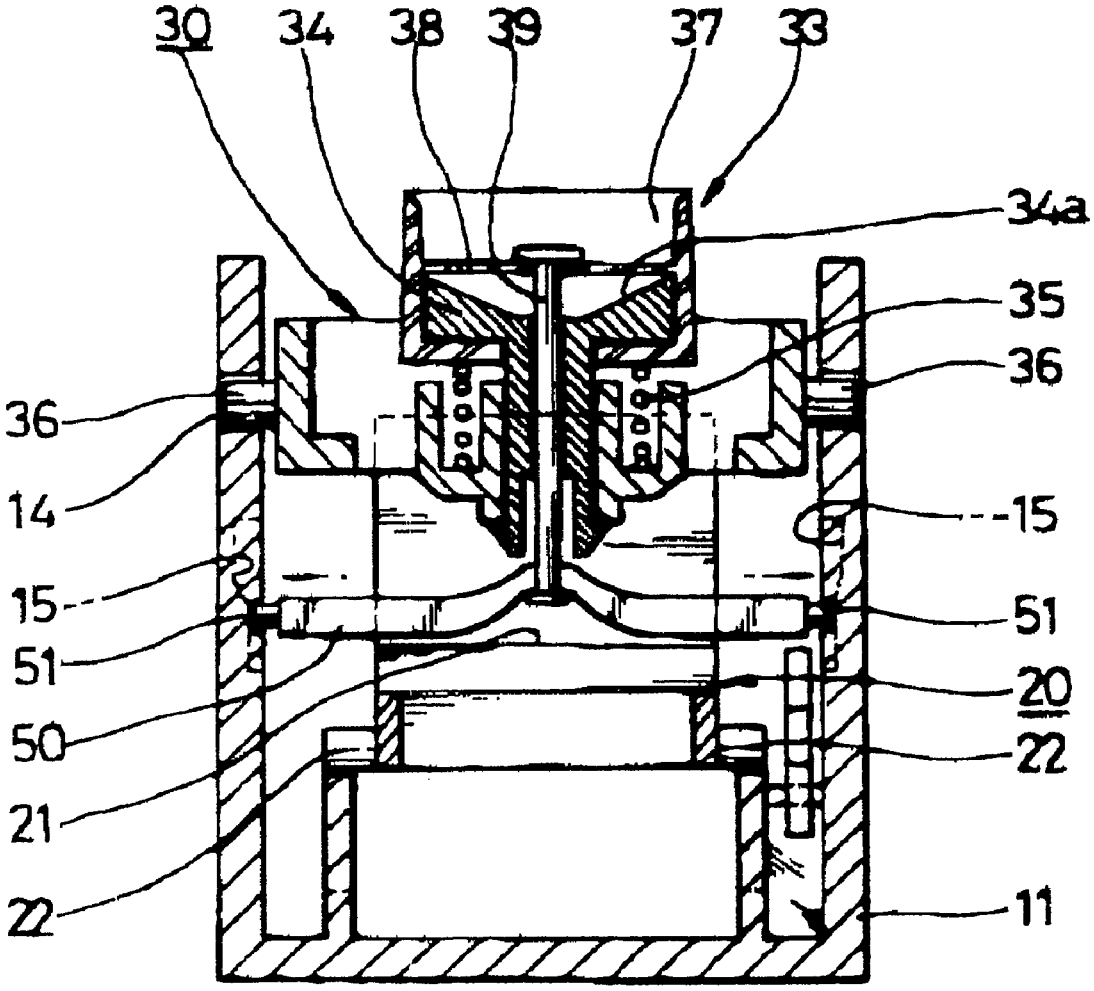
FIG. 5 is a sectional view taken on line X—X' of FIG. 4.

The rod guide 50 includes guiding projections 51 formed at both sides thereof, which are guided along cam grooves 15 formed on the inner walls of both sides of the housing 11 (see FIG. 5). When coupling the rod guide 50 into the housing 11. both sides of the rod guide 50 are pressed until the middle section thereof is projected to a certain degree. Then, the guiding projections 51 are inserted into the cam grooves 15.

Figure 3:
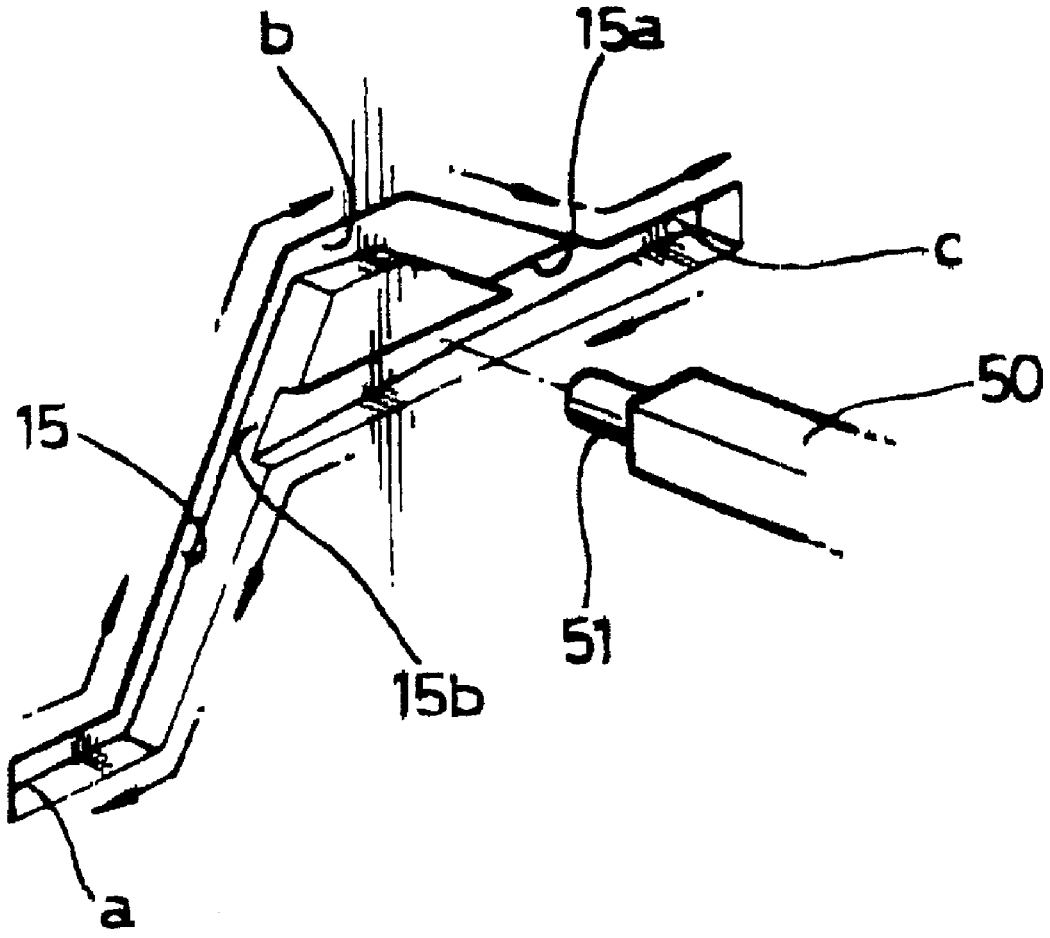
FIG. 3 is a perspective view for showing a cam groove according to the present invention.

As shown in FIG. 3, the cam grooves 15 extend from a lower dead center (a) to an upper dead center (b), and then to a middle dead center (c). Here, since the middle dead section (c) is in a horizontally linear shape, the guiding projections 51 horizontally move from the middle dead center (c) to the lower dead center (a). In order to guide the guiding projections 51 directly from the middle dead center (c) to the lower dead center (a), there formed a return prevention elevation 15*a* between the upper dead center (b) and the middle dead center (c). Further, an entrance preventing elevation 15*b* is formed for preventing guiding projections 51 from entering into a horizontal path 15*c* of the middle dead center (c) when the guiding projections 51 move from the lower dead center (a) to the upper dead center (b).

The cap guide 34 includes a certain space 34*a* formed therein for pulling the suction diaphragm 38 downward for a suctioning operation.

Reference is made to FIGS. 4 to 9 for explaining the operation of the present invention.

When the carriage 8 carried with the ink cartridge 1 thereon finishes the printing operation, the carriage 8 is moved to the service station device 10 to be in the standby mode, and then is reversely moved back to the printing area to perform the printing operation.

Figure 4:
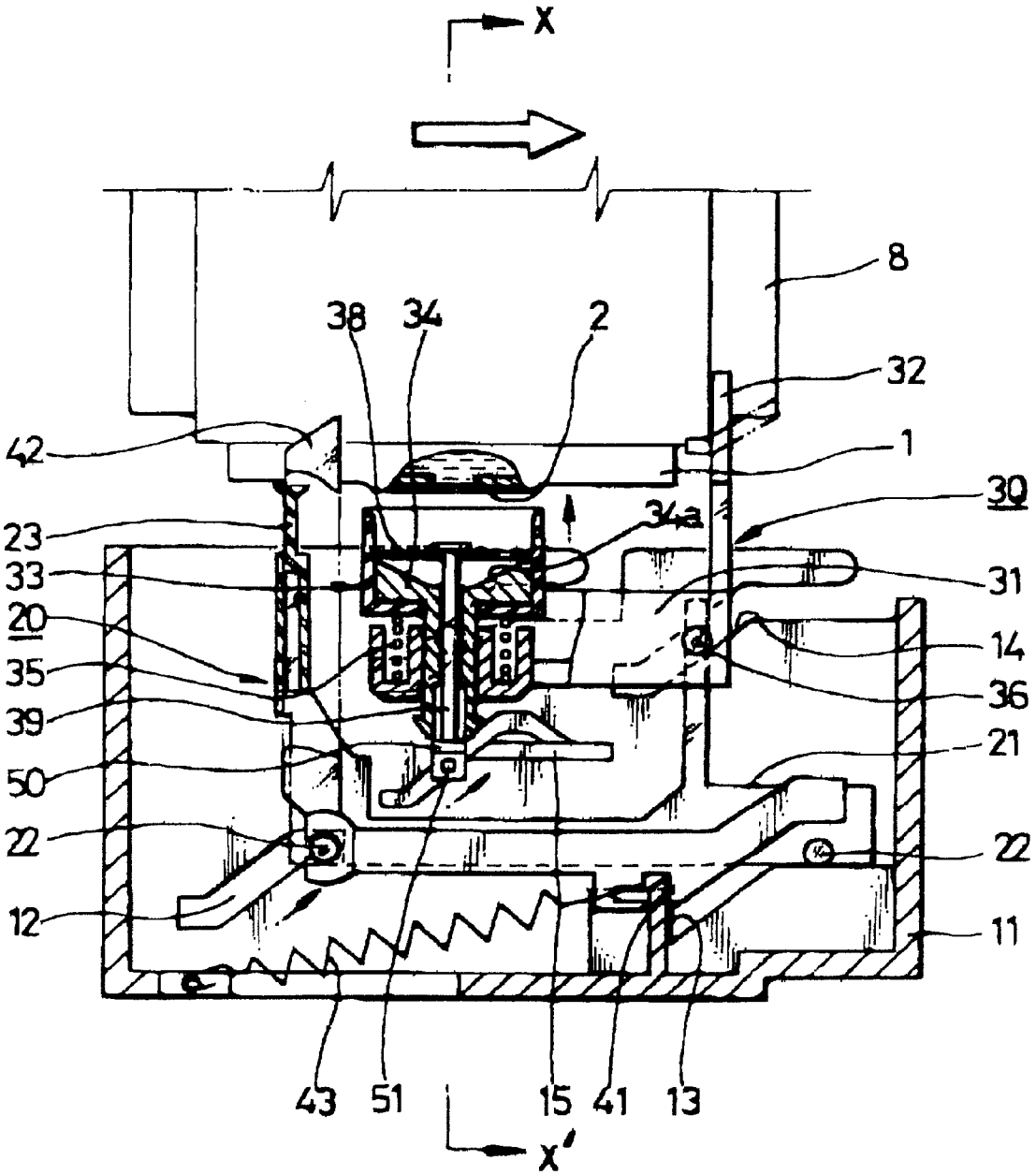
FIGS. 4 and 4A are a longitudinal sectional view and its schematic view, respectively, for showing an initial operation of the apparatus according to the present invention.

FIG. 4 shows the carriage 8 beginning to enter into the service station device 10 after completing the printing operation, in which the carriage 8 moves to the right hand side. Here, the movement of the carriage 8 to the service station device 10 for the standby mode is defined as a "home positional direction", while the reverse movement of the carriage 8 for the printing operation (to the left-hand side of FIG. 4) is defined as a "print positional direction".

Accordingly, when the carriage 8 is moved towards the home positional direction, the carriage pushes the lever 32 while it is moving. Accordingly, the capping guide 31 having the lever 32, and the wiper guide 21 locked with the capping guide 31 are moved along with the carriage 8 toward the same direction (i.e., the right-hand side of FIG. 4) as the carriage 8. Here, the wiper guide 21 and the capping guide 31 are moved while the guiding protrusions 22 and 36 are guided along the guiding sections 12 and 14. Since the guiding sections 12 and 14 are upwardly inclined, the wiper guide 21 and the capping guide 31 are upwardly moved, and accordingly the wiper 23 and the cap 33 are moved close to the nozzle 2.

Figure 4A:
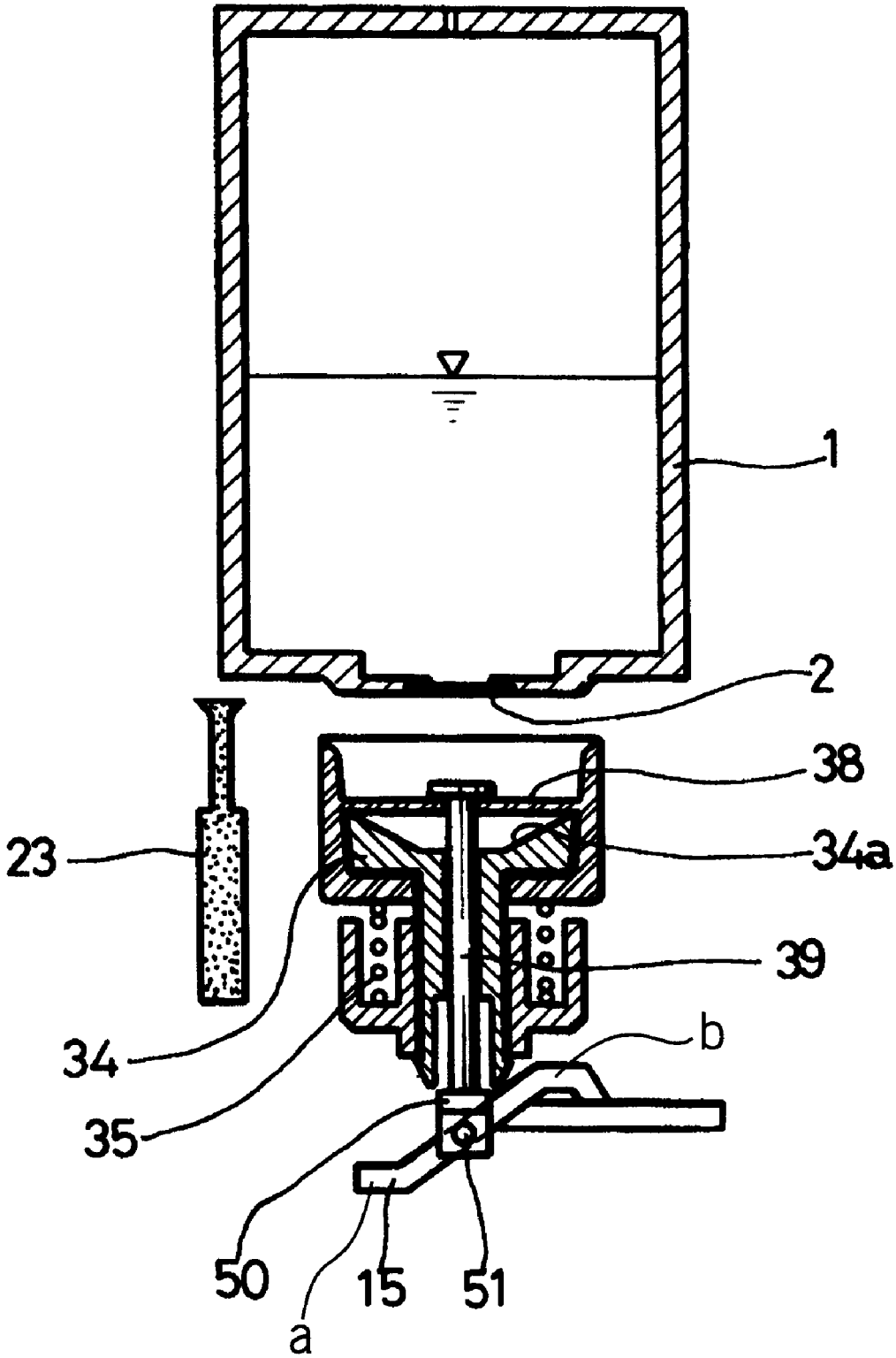

Referring to FIG. 4A, the guiding projections 51 of the rod guide 50 are moved from the lower dead center (a) to the upper dead center (b) along the inclined path. Here, the angle of inclination from the lower dead center (a) to the upper dead center (b) of the cam grooves are the same as the angle of inclination of the guiding section 14 for guiding the movement of the capping guide 31, and accordingly, the rod guide 50, inclusive of the suction rod 39, is upwardly moved while maintaining the state that the suction rod 39 does not push the suction diaphragm 38.

Figure 6:
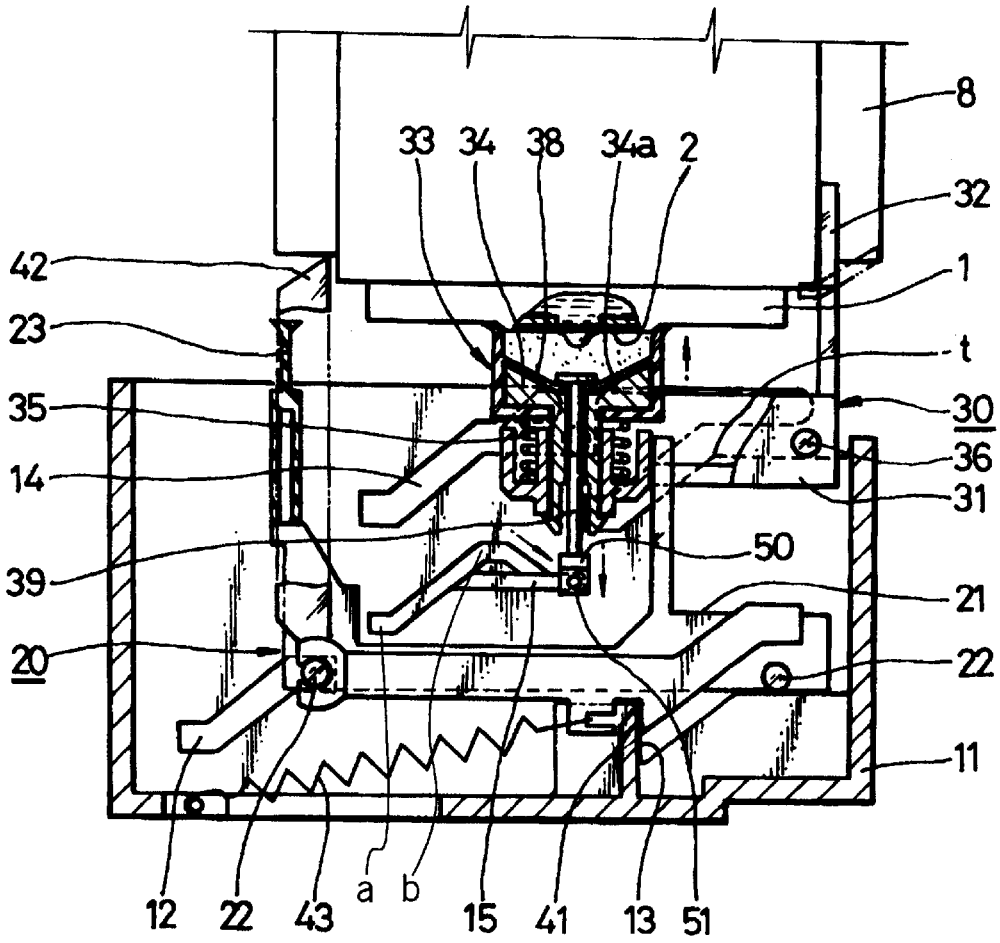
FIGS. 6 and 6A are a longitudinal sectional view and its schematic view, respectively. for showing the main operation of the apparatus according to the present invention.

FIG. 6 shows the carriage 8 in its completed state, in which the carriage 8 carrying the ink cartridge 1 is in the standby mode. In this state, the wiper guide 21 and the capping guide 31 are at the extreme upper position.

Accordingly, the cap 33 is tightly attached to the nozzle 2 and seals the nozzle 2. The nozzle 2 starts to be sealed when the guiding protrusions 36 of the capping guide 31 are passed through the inclined portion of the guiding section 14 to the entry of the horizontal path (area t of FIG. 6). After being moved to a certain distance, the guiding protrusions 36 are stopped.

Figure 6A:
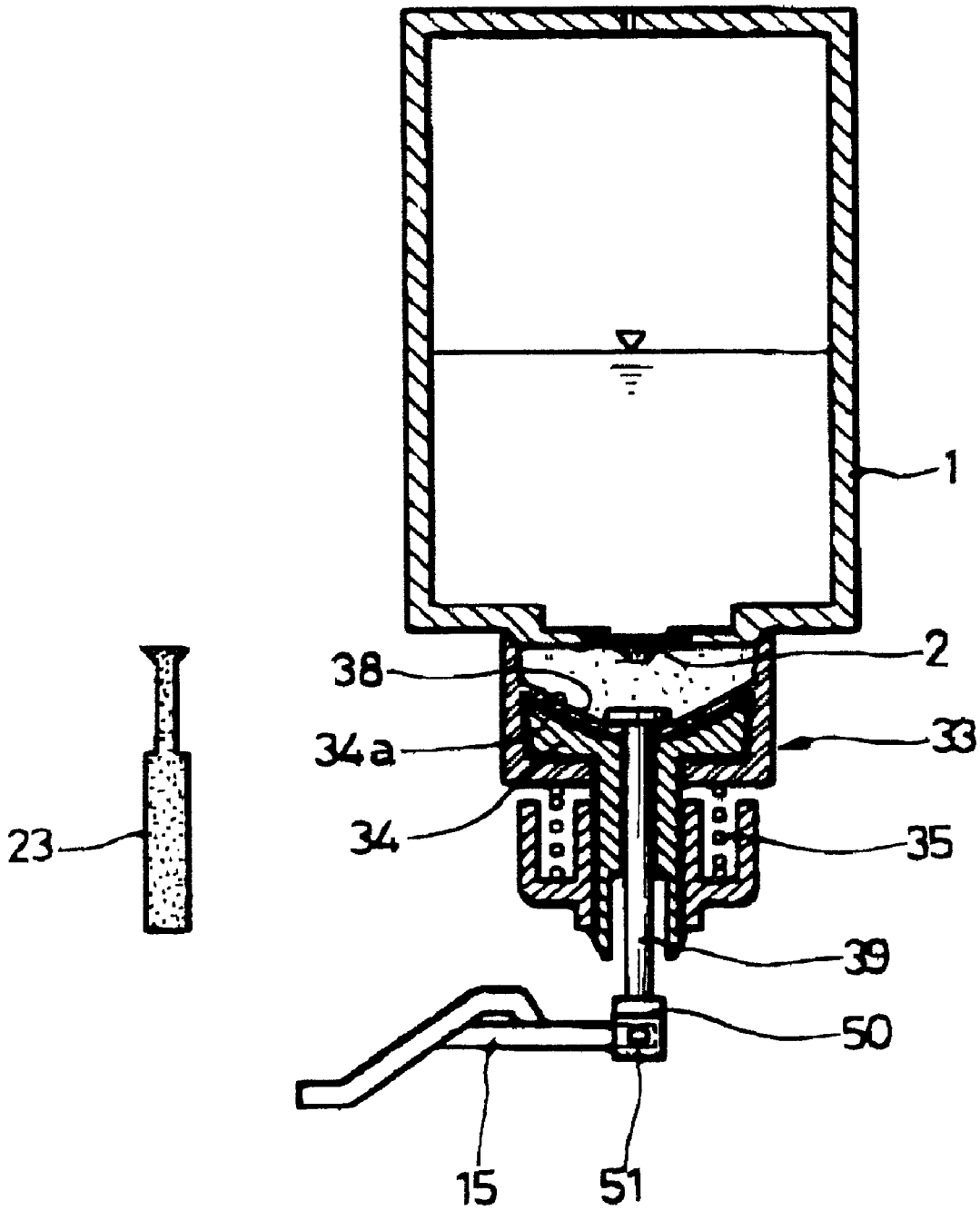

During the above process, the guiding projections 51 of the rod guide 50 are moved along the cam grooves 15 as follows. Referring to FIG. 6A, when the guiding protrusions 36 of the capping guide 31 are moved along the inclined path of the guiding section 14 and past the entrance (area t) of the horizontal path thereof, the guiding projections 51 of the rod guide 50 are passed to the upper dead center (b) of the cam grooves 15.

Next. when the guiding protrusions 36 of the capping guide 31 are moved along the horizontal path of the guiding section 14, the guiding projections 51 are lowered to the middle dead center (c) and horizontally moved at a certain distance.

Figure 7:
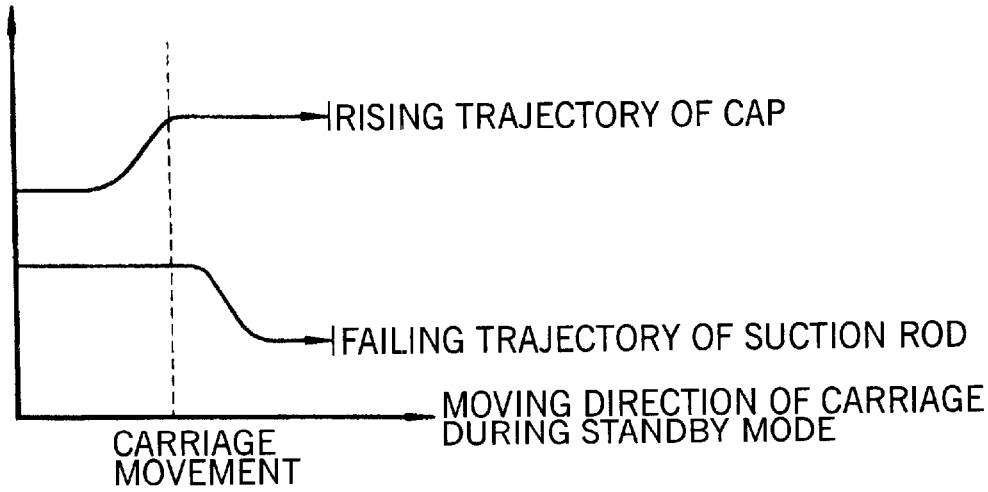
FIG. 7 is a view for showing the operational trajectory of a cap and a suction rod according to the present invention.

More specifically, while the capping guide 31 is raised and then horizontally moved to seal the nozzle 2 with the cap 33, the suction rod 39 connected with the rod guide 50 is lowered downward and then moved horizontally (see FIG. 7).

Since the suction diaphragm 38 connected to the suction rod 39 is pulled to the opposite direction from the nozzle 2. the suction diaphragm 38 is extended, thus accordingly expanding the volume of the cap space 37. Further, as the volume of the cap space 37 increases, the capillary tube (nozzle hole) of the nozzle 2 is subjected to a negative pressure, permitting a predetermined amount of ink to be sucked out.

After being sucked out, the ink stays on the inlet of the nozzle 2 under the same surface tension as the gravity. More specifically, a proper amount of ink which would not be dropped due to the gravity is sucked out, and vaporizes or volatilizes on the surface of the nozzle 2. As the vapor of ink reaches a saturated water vapor pressure within the seated cap space 37, the ink enters into an equilibrium state in which it does not vaporize any longer.

Accordingly, even though the ink at the nozzle inlet vaporizes somewhat, since there is no vaporization after a certain amount of ink vaporizes, a certain amount of ink still stays at the inlet of the nozzle 2. The ink at the nozzle inlet is sufficient to prevent drying of the inlet of the nozzle 2 during the standby mode, i.e., while the nozzle 2 is sealed by the cap 33, and accordingly, any blockage in the nozzle 2 is prevented, and the sludge, which has been caused due to the ink drying, is also prevented.

Figure 8:
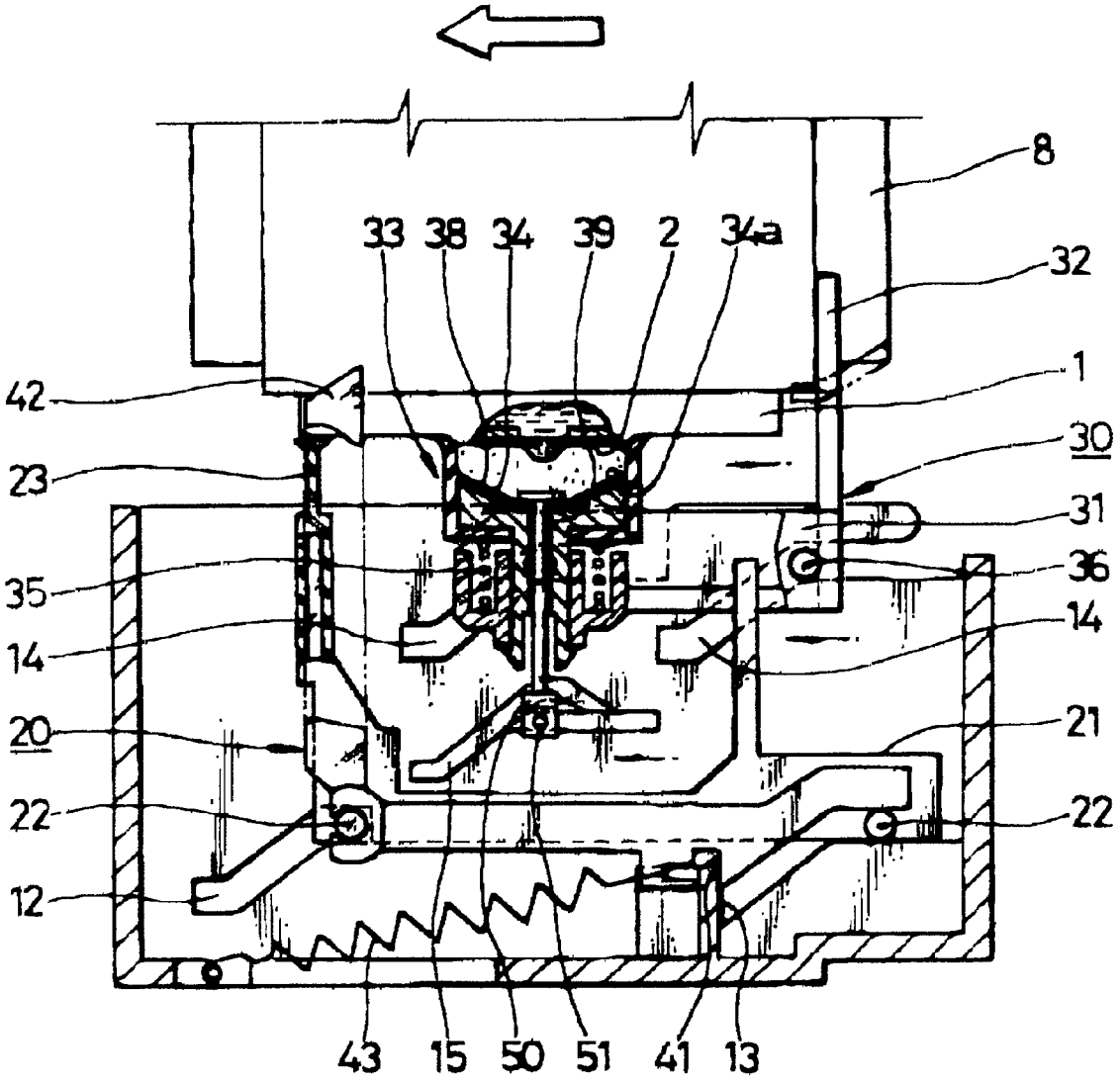
FIGS. 8 and 8A are a longitudinal sectional view and its schematic view, respectively, for showing the initial operation of the apparatus according to the present invention.

FIG. 8 shows the carriage 8 moving to the print positional direction for the printing operation. In this situation, the carriage 8 is moved to the left-hand side of FIG. 8, while pushing the unlocking lever 42, and accordingly, the locking rod 40 is pivoted, and the locking tongue 41 is released from the locking elevation 13. Accordingly, the wiper guide 21 is released. and is capable of moving along with the capping guide 31. Further, as the wiper guide 21 and the capping guide 31 are moved to the left-hand side of FIG. 8 by the elastic member 35, the wiper guide 21 and the capping guide 31 are lowered downward.

Figure 8A:
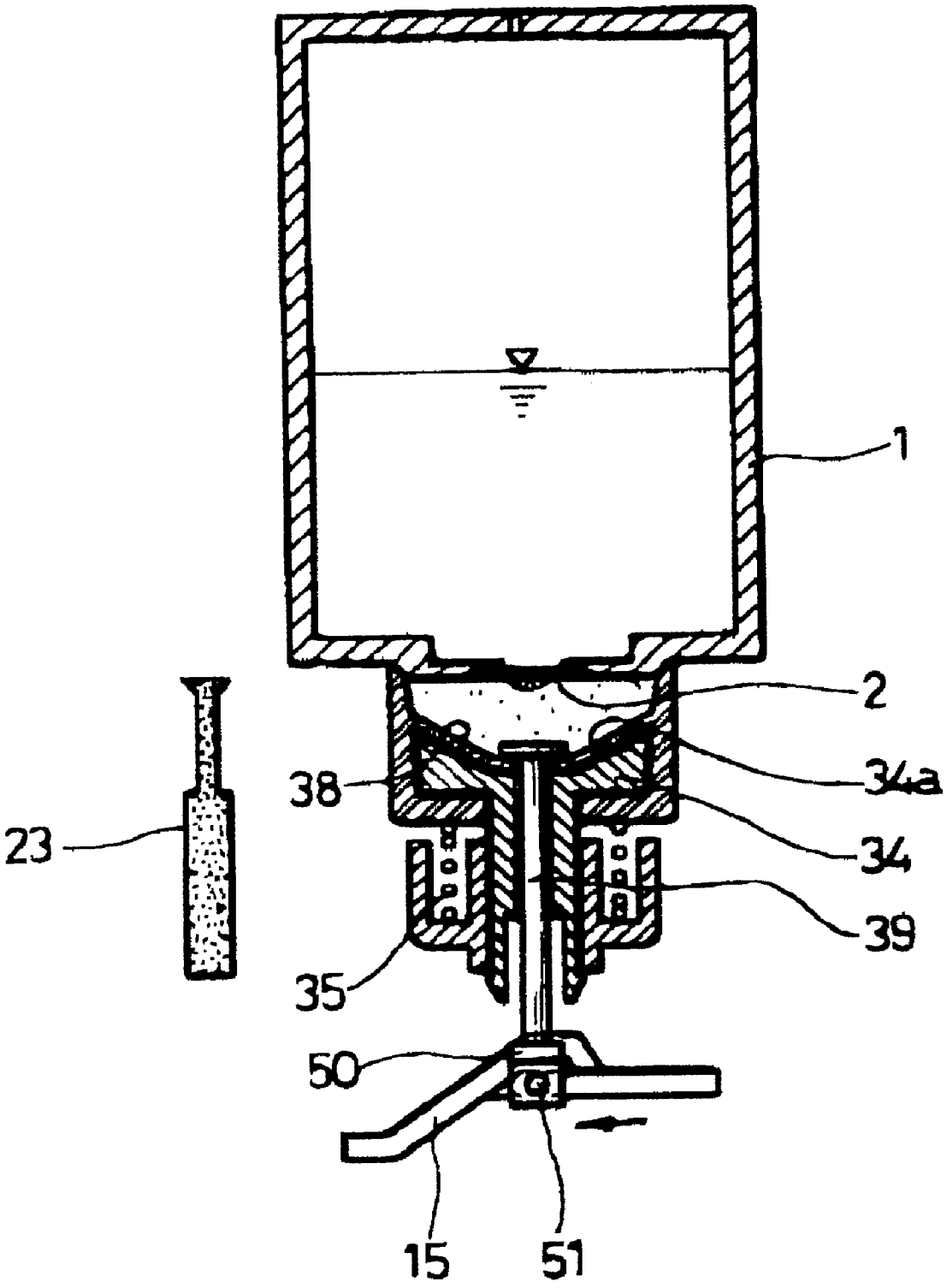

Here, the guiding projections 51 of the rod guide 50 are horizontally moved from the middle dead center (c), accordingly pulling the suction diaphragm 38 as shown in FIG. 8A.

Such a state shown in FIG. 8A is maintained until the wiper guide 21 and the capping guide 31 are lowered downward, the situation that the cap 33 is separated from the nozzle 2, and the suction rod 39 and the suction diaphragm 38 are raised simultaneously.

Figure 9:
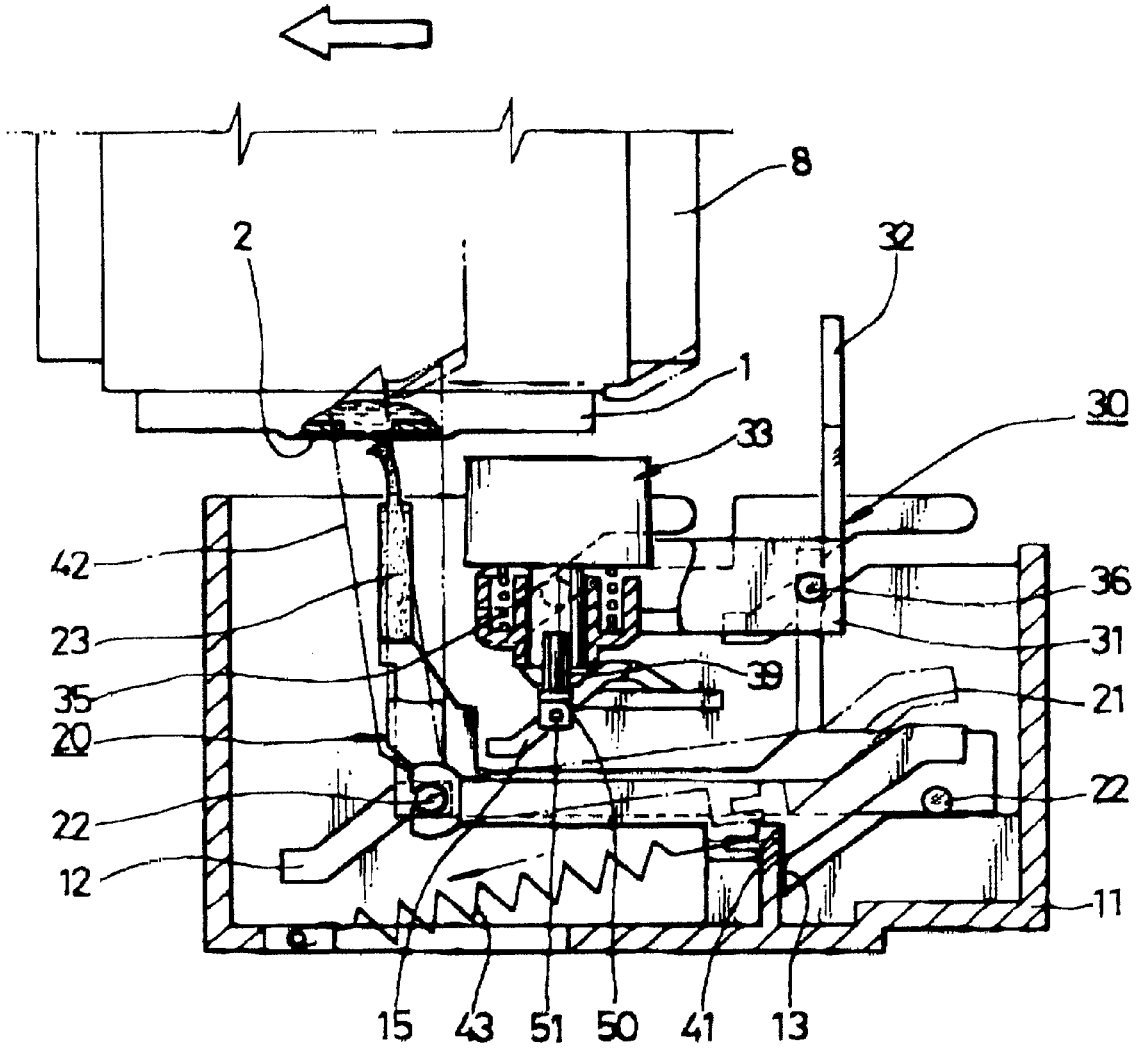
FIGS. 9 and 9A are a longitudinal sectional view and its schematic view, respectively, for showing the wiping operation of the apparatus according to the present invention.
Figure 9A:
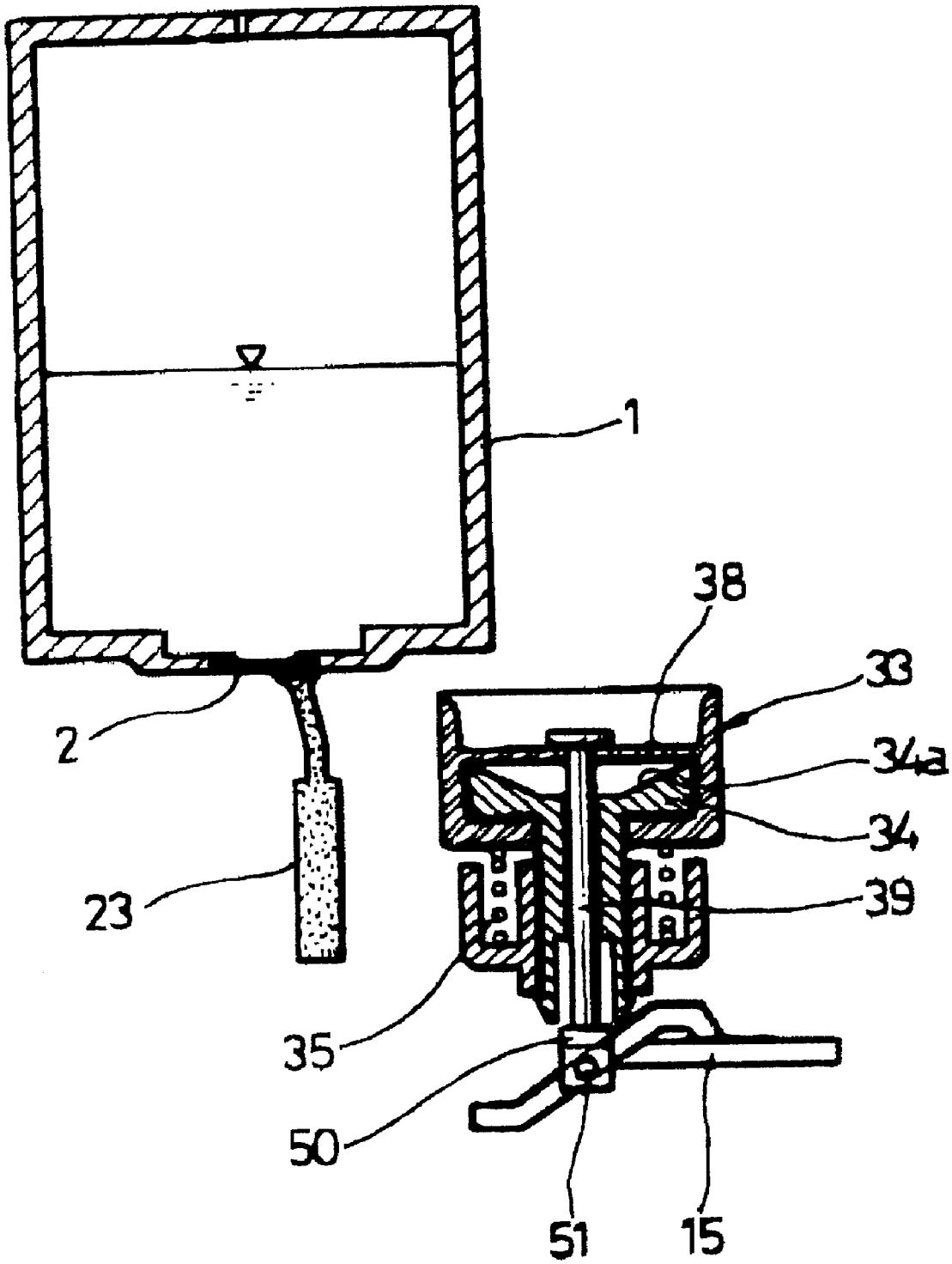

As shown in FIGS. 9 and 9A. the above state is maintained until the wiper 23 performs the wiping operation to wipe out the ink droplets at the nozzle 2 during the movement of the carriage 8.

Figure 10:
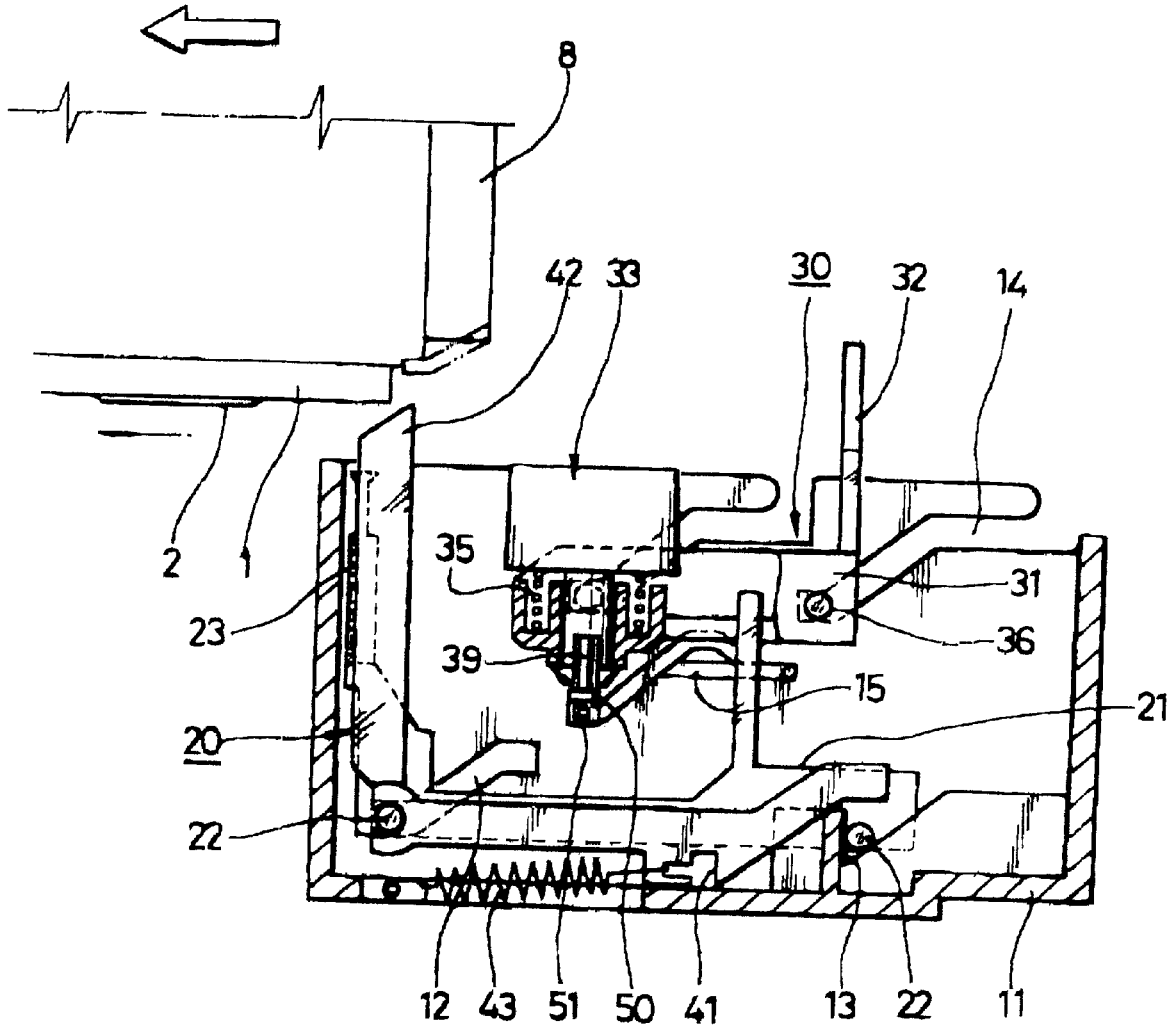
FIG. 10 is a longitudinal sectional view for showing the apparatus according to the present invention in its finished mode.

Accordingly, as shown in FIG. 10, the carriage 8 is moved for the printing operation while having no ink blockage in the nozzle 2 of the ink cartridge 1 which is mounted on the carriage 8, and the service station device 10 comes into the standby mode while the capping guide 31 and the wiper guide 20 are lowered downward.

As described above, according to the present invention, the ink droplets are sucked out from the nozzle 2 during the capping operation, and accordingly, the drying of the nozzle 2 is prevented.

Further, since ink is sucked out during the capping operation without a separate driving force, the structure is simplified, and the price per unit is reduced.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. An ink jetting nozzle maintenance apparatus of an image forming apparatus, comprising:

a cap preventing a blockage in a nozzle on a printing standby mode, said cap comprising a suction diaphragm expanding the volume of a cap space formed during a sealing of said nozzle, said suction diaphragm being extended by a suction diaphragm lowering unit lowering said suction diaphragm in an opposite direction from said nozzle expanding the volume of the cap space when said cap seals said nozzle and additionally moves a certain distance;

the cap space being subjected to a negative pressure by the extending of said suction diaphragm to permit a certain amount of ink to be sucked out of said nozzle preventing the drying of an inlet of said nozzle; and said nozzle having ink sucked out under the negative pressure into droplets to prevent said nozzle from drying during the sealing of said nozzle by said cap and the ink being wiped out of said nozzle by a wiper during a wiping operation of the printing operation, the sealing of said nozzle by said cap, the wiping of said nozzle, and the suctioning of ink from said nozzle being driven by a reciprocal movement of a carriage.

2. The ink jetting nozzle maintenance apparatus as claimed in claim 1, with said cap being formed of a rubber substance having a certain elasticity extending said suction diaphragm.

3. The ink jetting nozzle maintenance apparatus of claim 1, further comprising a capping device and a wiping device raising and lowering said cap and said wiper.

4. The ink jetting nozzle maintenance apparatus of claim 3, further comprising a service station driving said capping and wiping devices by a reciprocal movement of said carriage carrying an ink cartridge during the printing operation.

5. The ink jetting nozzle maintenance apparatus of claim 1, further comprising a service station having a carriage carrying an ink cartridge during the printing operation, said service station driving said capping and wiping devices by a reciprocal movement of said carriage.

6. The ink jetting nozzle maintenance apparatus of claim 5, with said suction diaphragm and said cap being integrally formed with each other.

7. An ink jetting nozzle maintenance apparatus, comprising:

a cap preventing a blockage in a nozzle on a printing standby mode, said cap comprising a suction diaphragm expanding the volume of a cap space formed during a sealing of said nozzle, said suction diaphragm being extended by a suction diaphragm lowering unit lowering said suction diaphragm in an opposite direction from said nozzle expanding the volume of the cap space when said cap seals said nozzle and additionally moves a certain distance;

the cap space being subjected to a negative pressure by the extending of said suction diaphragm to permit a certain amount of ink to be sucked out of said nozzle preventing the drying of an inlet of said nozzle; and said nozzle having ink sucked out under the negative pressure into droplets to prevent said nozzle from drying and the ink being wiped out of said nozzle by a wiper during a wiping operation of the printing operation, with said diaphragm lowering unit comprising:

a suction rod pulling said suction diaphragm;

a rod guide connected to said suction rod accommodating a lowering movement of said suction rod; and a cam groove formed on an inner wall of a housing guiding an upward and downward movement of said rod guide.

8. The inkjetting nozzle maintenance apparatus as claimed in claim 7, with the cam groove being at a predetermined trajectory in a lowering operation, the lowering operation being a pulling of said suction diaphragm from the point when said cap seals said nozzle.

9. An ink jetting nozzle maintenance apparatus of an image forming apparatus, comprising:

an ink cartridge holding ink in a printing operation, said ink cartridge jetting the ink to an ink nozzle when receiving a printing command;

a carriage reciprocally moving on a printable medium in a horizontal direction while carrying said ink cartridge in the printing operation, said carriage moving to the service area during a standby mode or a power-off period;

a service station device driven by the reciprocal movement of said carriage, said service station device comprising:

a cap sealing said ink nozzle to prevent said ink nozzle of said ink cartridge from drying; and a wiper accommodating wiping of said ink nozzle during the printing operation or during a feeding of the printable medium;

a suction diaphragm formed in said cap preventing said ink nozzle from drying by sucking out a certain amount of ink from said ink nozzle by using said cap; and a diaphragm lowering unit driven by the reciprocal movement of said carriage driving said service station device, said diaphragm lowering unit generating a pulling force pulling said suction diaphragm to generate a negative pressure to suction the ink from said ink nozzle during the sealing of said nozzle with said cap.

10. The ink jetting nozzle maintenance apparatus as claimed in claim 9, with the ink sucked out under the negative pressure remaining at said ink nozzle preventing said ink nozzle from drying, and the ink being wiped out by said wiper during the wiping operation of the printing operation.

11. The ink jetting nozzle maintenance apparatus as claimed in claim 9, said cap comprising said suction diaphragm formed of a rubber member having a certain elasticity accommodating the extending of said suction diaphragm.

12. An ink jetting nozzle maintenance apparatus of an image forming apparatus, comprising:

an ink cartridge holding ink in a printing operation, said ink cartridge jetting the ink to an ink nozzle when receiving a printing command;

a carriage reciprocally moving on a printable medium in a horizontal direction while carrying said ink cartridge in the printing operation, said carriage moving to the service area during a standby mode or a power-off period;

a service station device driven by the reciprocal movement of said carriage, said service station device comprising:

a cap sealing said ink nozzle to prevent said ink nozzle of said ink cartridge from drying; and a wiper accommodating wiping of said ink nozzle during the printing operation or during a feeding of the printable medium;

a suction diaphragm formed in said cap preventing said ink nozzle from drying by sucking out a certain amount of ink from said ink nozzle by using said cap; and a diaphragm lowering unit driven by the reciprocal movement of said carriage driving said service station device, said diaphragm lowering unit generating a pulling force pulling said suction diaphragm to generate a negative pressure to suction the ink from said ink nozzle, with said diaphragm lowering unit comprising:

a suction rod pulling said suction diaphragm;

a rod guide connected to said suction rod accommodating a lowering movement of said suction rod; and a cam groove formed on an inner wall of a housing guiding an upward and downward movement of said rod guide.

13. The ink jetting nozzle maintenance apparatus as claimed in claim 12, with the cam groove being at a certain trajectory accommodating a lowering operation pulling said suction diaphragm from the point when said cap seals said ink nozzle.

14. An ink jetting nozzle maintenance apparatus of an image forming apparatus, comprising:

a cap preventing a blockage in a nozzle on a printing standby mode, said cap comprising a suction diaphragm expanding the volume of a cap space formed during a sealing of said nozzle, said suction diaphragm being extended by a suction diaphragm lowering unit lowering said suction diaphragm in an opposite direction from said nozzle expanding the volume of the cap space when said cap seals said nozzle and additionally moves a certain distance;

the cap space being subjected to a negative pressure by the extending of said suction diaphragm to permit a certain amount of ink to be sucked out of said nozzle preventing the drying of an inlet of said nozzle;

said nozzle having ink sucked out under the negative pressure into droplets to prevent said nozzle from drying and the ink being wiped out of said nozzle by a wiper during a wiping operation of the printing operation; and a service station having a carriage carrying an ink cartridge during the printing operation, said service station driving said capping and wiping devices by a reciprocal movement of said carriage, with said suction diaphragm and said cap being integrally formed with each other, with the cam grooves having an angle of inclination approximately equal to an angle of inclination of a groove guiding a movement of said capping device.

15. The ink jetting nozzle maintenance apparatus of claim 14, further comprising a locking unit securing said capping and wiping device, said locking unit having a lever unlocking said capping and wiping devices with a pushing force of said carriage against said lever.

16. A method of maintenance of an ink jetting nozzle for an image forming apparatus, comprising:

holding ink in an ink cartridge during a printing operation, said ink cartridge jetting the ink to an ink nozzle when receiving a printing command;

moving reciprocally a carriage on a printable medium in a horizontal direction while carrying said ink cartridge in the printing operation, said carriage moving to the service area during a standby mode or a power-off period;

driving a service station device by the reciprocal movement of said carriage, said service station device having a cap and a wiper, said cap sealing said ink nozzle to prevent said ink nozzle of said ink cartridge from drying, said wiper accommodating wiping of said ink nozzle during the printing operation or during a feeding of the printable medium;

forming a suction diaphragm in said cap preventing said ink nozzle from drying by sucking out a certain amount of ink from said ink nozzle by using said cap; and driving a diaphragm lowering unit by the reciprocal movement of said carriage driving said service station device, said diaphragm lowering unit generating a pulling force pulling said suction diaphragm to generate a negative pressure to suction the ink from said ink nozzle during the sealing of said nozzle with said cap.

17. The method of claim 16, with the ink being sucked out under the negative pressure remaining at said ink nozzle preventing said ink nozzle from drying, and the ink being wiped out by said wiper during the wiping operation of the printing operation.

18. The method of claim 17, with said cap comprising said suction diaphragm forming of a rubber member having a certain elasticity accommodating the extending of said suction diaphragm.

19. A method of maintenance of an ink jetting nozzle for an image forming apparatus, comprising:

holding ink in an ink cartridge during a printing operation, said ink cartridge jetting the ink to an ink nozzle when receiving a printing command;

moving reciprocally a carriage on a printable medium in a horizontal direction while carrying said ink cartridge in the printing operation, said carriage moving to the service area during a standby mode or a power-off period:

driving a service station device by the reciprocal movement of said carriage, said service station device having a cap and a wiper, said cap sealing said ink nozzle to prevent said ink nozzle of said ink cartridge from drying, said wiper accommodating wiping of said ink nozzle during the printing operation or during a feeding of the printable medium;

forming a suction diaphragm in said cap preventing said ink nozzle from drying by sucking out a certain amount of ink from said ink nozzle by using said cap; and driving a diaphragm lowering unit by the reciprocal movement of said carriage driving said service station device, said diaphragm lowering unit generating a pulling force pulling said suction diaphragm to generate a negative pressure to suction the ink from said ink nozzle, with the ink being sucked out under the negative pressure remaining at said ink nozzle preventing said ink nozzle from drying, and the ink being wiped out by said wiper during the wiping operation of the printing operation, with said cap comprising said suction diaphragm forming of a rubber member having a certain elasticity accommodating the extending of said suction diaphragm, with said diaphragm lowering unit further comprising:

pulling said suction diaphragm by a suction rod;

connecting by a rod guide to said suction rod accommodating a lowering movement of said suction rod; and forming a cam groove on an inner wall of a housing guiding an upward and downward movement of said rod guide.

20. The method of claim 19, with the cam groove being at a certain trajectory accommodating a lowering operation pulling said suction diaphragm from the point when said cap seals said ink nozzle.

* * * * *